US011406127B2

(12) United States Patent
Kaljura

(10) Patent No.: US 11,406,127 B2
(45) Date of Patent: Aug. 9, 2022

(54) SMOKING ARTICLE AND MOUTHPIECE THEREFOR

(71) Applicant: British American Tobacco (Investments) Limited, London (GB)

(72) Inventor: Karl Kaljura, London (GB)

(73) Assignee: NICOVENTURES TRADING LIMITED, London (GB)

( * ) Notice: Subject to any disclaimer, the term of this patent is extended or adjusted under 35 U.S.C. 154(b) by 0 days.

(21) Appl. No.: 15/554,071

(22) PCT Filed: Feb. 26, 2016

(86) PCT No.: PCT/GB2016/050504
§ 371 (c)(1),
(2) Date: Aug. 28, 2017

(87) PCT Pub. No.: WO2016/135503
PCT Pub. Date: Sep. 1, 2016

(65) Prior Publication Data

US 2018/0035708 A1 Feb. 8, 2018

(30) Foreign Application Priority Data

Feb. 27, 2015 (GB) ..... 1503389

(51) Int. Cl.
*A24D 3/06* (2006.01)
*A24D 3/04* (2006.01)
(Continued)

(52) U.S. Cl.
CPC ..... *A24D 3/061* (2013.01); *A24C 5/56* (2013.01); *A24D 3/04* (2013.01); *A24D 3/041* (2013.01); *A24D 3/10* (2013.01); *A24D 3/18* (2013.01)

(58) Field of Classification Search
CPC ..... A24D 3/061; A24B 15/30
(Continued)

(56) References Cited

U.S. PATENT DOCUMENTS 1,174,109 A 3/1916 Wartemann
4,809,718 A 3/1989 Deal
(Continued)

FOREIGN PATENT DOCUMENTS

EP 0628260 A2 12/1994
EP 1754419 A1 2/2007
(Continued)

OTHER PUBLICATIONS

International Preliminary Report on Patentability for corresponding application PCT/GB2016/050502 filed Feb. 26, 2016; dated Jun. 12, 2017.
(Continued)

*Primary Examiner* — Eric Yaary
*Assistant Examiner* — Jennifer A Kessie
(74) *Attorney, Agent, or Firm* — Cantor Colburn LLP

(57) ABSTRACT

The invention relates to a smoking article (120) comprising a smoking article rod portion (2) having a recess (13) and a mouthpiece (110) arranged to be attached to the smoking article. The mouthpiece comprises an elongate cylindrical element (20) having adjacent first and second portions each extending partially along the length of the cylindrical element, the first portion being arranged to be inserted into a smoking article recess by a user. The mouthpiece also comprises an annular element (111) arranged around the second portion of the cylindrical element, the annular element having a larger external diameter than the cylindrical element such that the annular element is larger than the diameter of the recess.

12 Claims, 9 Drawing Sheets

(51) Int. Cl.
*A24C 5/56* (2006.01)
*A24D 3/10* (2006.01)
*A24D 3/18* (2006.01)

(58) Field of Classification Search
USPC ..... 131/337
See application file for complete search history.

(56) References Cited

U.S. PATENT DOCUMENTS

| | | | | |
|---|---|---|---|---|
| 4,898,190 | A | 2/1990 | Deal | |
| 5,622,190 | A | 4/1997 | Arterbery | |
| 5,630,628 | A | 5/1997 | Monch | |
| 2011/0120481 | A1 | 5/2011 | Besso et al. | |
| 2013/0081644 | A1* | 4/2013 | Noda | A24D 1/02 131/337 |
| 2014/0332014 | A1* | 11/2014 | Penrose | A24D 3/061 131/274 |
| 2015/0020826 | A1 | 1/2015 | Liu | |
| 2015/0296877 | A1 | 10/2015 | Nappi | |

FOREIGN PATENT DOCUMENTS

| | | | |
|---|---|---|---|
| FR | 1290954 | | 4/1962 |
| JP | 2008531008 | A | 8/2008 |
| JP | 5164217 | B2 | 12/2012 |
| JP | 2015502159 | A | 1/2015 |
| KR | 2020100007430 | U | 7/2010 |
| WO | 2006090290 | A1 | 8/2006 |
| WO | 2009077244 | A1 | 6/2009 |
| WO | 2009157240 | A1 | 12/2009 |
| WO | 2011104829 | A1 | 9/2011 |
| WO | 2012023515 | A1 | 2/2012 |
| WO | 2013000967 | A1 | 1/2013 |
| WO | 2013118299 | A1 | 8/2013 |

OTHER PUBLICATIONS

International Preliminary Report on Patentability for corresponding application PCT/GB2016/050503 filed Feb. 26, 2016; dated Jun. 7, 2017.

International Preliminary Report on Patentability for corresponding application PCT/GB2016/050504 filed Feb. 26, 2016; dated Jun. 12, 2017.

International Search Report for corresponding application PCT/GB2016/050502 filed Feb. 26, 2016; dated May 3, 2016.

International Search Report for corresponding application PCT/GB2016/050503 filed Feb. 26, 2016; dated May 09, 2016.

International Search Report for corresponding application PCT/GB2016/050504 filed Feb. 26, 2016; dated May 9, 2016.

Response to the Written Opinion of the IPEAfor corresponding application No. PCT/GB2016/050504 dated Mar. 13, 2017.

Written Opinion for corresponding application PCT/GB2016/050502 filed Feb. 26, 2016; dated May 3, 2016.

Written Opinion for corresponding application PCT/GB2016/050504 filed Feb. 26, 2016; dated May 9, 2016.

Written Opinion of the International Searching Authority for corresponding application PCT/GB2016/050503 filed Feb. 26, 2016; dated May 9, 2016.

Russian Office Action for corresponding application 2017133470 filed Feb. 26, 2016; Report dated Jun. 29, 2018.

JP Office Action dated Mar. 9, 2021 re: Application No. 2020-052844, pp. 18, citing: JP 2018-506288 A, JP 2014-518079 A, U.S. Pat. No. 4,809,718 A, JP 2008-531008 A and WO 2009/157240 A.

* cited by examiner

SMOKING ARTICLE AND MOUTHPIECE THEREFOR

CROSS REFERENCE TO RELATED APPLICATIONS

This application is related to International Patent Application Numbers PCT/EP2016/050503 and PCT/EP2016/050502, both filed on Feb. 16, 2016, and both having entered the U.S. National Phase under 35 U.S.C. 371 on Aug. 28, 2017 as U.S. application Ser. Nos. 15/554,059 and 15/554,077, respectively, where the entire contents of all of said applications are herein incorporated by reference.

TECHNICAL FIELD

The invention relates to a smoking article and a mouthpiece therefor, particularly but not exclusively to a smoking article, a mouthpiece for a smoking article and a method for forming a mouthpiece for a smoking article.

BACKGROUND

Cigarettes and other smoking articles produce an aerosol, smoke in the case of cigarettes, which is inhaled by a user. Filters for smoking articles are used to modify the aerosol before it reaches the user's mouth. Filters known in the art for this purpose may be formed from a plug of fibrous cellulose acetate or other materials with similar physical properties.

To enhance the removal of certain smoke constituents various additives may be added to smoking article filters. Examples include smoke adsorbents such as activated carbon which adsorbs certain smoke constituents thus removing them from the smoke stream passing through the filter. In addition to removing constituents from smoke, filter additives may impart characteristics to smoke or other aerosols passing through the filter. For example, fragrances and flavourants may be incorporated into the filter which alter the aroma and taste characteristics of the aerosol.

SUMMARY

In accordance with aspects of the invention, there is provided a smoking article comprising a smoking article rod portion having a recess and a mouthpiece attachable to the smoking article rod portion comprising an elongate cylindrical element having adjacent first and second portions each extending partially along the length of the cylindrical element, the first portion being arranged to be inserted into the recess by a user, and an annular element arranged around the second portion of the cylindrical element, the annular element having a larger external diameter than the internal diameter of the recess.

The cylindrical element and/or annular element can comprise a wrapper forming at least part of the outer surface of the cylindrical element and/or annular element.

The internal diameter and/or length of the recess and the external diameter and/or length of the first portion of the cylindrical element can be arranged to substantially correspond such that the first portion of the cylindrical element can be received within and substantially fill the recess.

The cylindrical element and/or annular element can comprise a smoke modifying additive. The smoke modifying additive can be distributed throughout the cylindrical element and/or annular element, the smoke modifying additive can be contained within at least one frangible capsule, the smoke modifying additive can comprise a botanical additive, the smoke modifying additive can comprise an adsorbent and/or the additive can be loaded on a thread extending through the cylindrical element and/or annular element.

The annular element can be attached to the cylindrical element using an adhesive.

The first portion of the cylindrical element can comprise an outer surface having at least one raised area, and the at least one raised area can be arranged to engage with an inner surface of the recess.

The at least one raised area can provide a resistance to the movement of the first portion of the cylindrical element within the recess and can be arranged to provide a lower resistance to movement of the cylindrical element into the recess than out of the recess.

The at least one raised area can be formed by embossing an outer surface of the cylindrical element.

The annular element can be formed from a sheet material wrapped around the second portion of the cylindrical element.

The body of the cylindrical element and/or annular element can comprise fibrous filtration material.

The first portion of the cylindrical element can comprise an outer surface having at least one circumferentially extending raised area configured to engage with an inner surface of the corresponding recess to prevent or restrict air flow between the inner surface of the corresponding recess and the outer surface of the cylindrical element.

The first portion of the cylindrical element can comprise a wrapper forming at least part of the outer surface of the first portion of the cylindrical element, and wherein the at least one circumferentially extending raised area is formed by embossing the wrapper.

The circumferentially extending raised area can extend around substantially the whole circumference of the cylindrical element.

The cylindrical element can have a mouth end to be received in a user's mouth and an insertion end for insertion into the recess, and wherein the annular element extends beyond the mouth-end of the cylindrical element, forming a recess at the mouth-end of the mouthpiece.

The cylindrical element and the annular element can have the same length.

In accordance with further aspects of the invention, there is provided a mouthpiece for attachment to a smoking article by a user, the mouthpiece comprising an elongate cylindrical element having adjacent first and second portions each extending partially along the length of the cylindrical element, the first portion being arranged to be inserted into a corresponding recess in the smoking article by the user and an annular element arranged around the second portion of the cylindrical element, the annular element having a larger external diameter than the cylindrical element.

In accordance with further aspects of the invention, there is provided a method for forming a mouthpiece as defined above, comprising forming an elongate cylinder of filter material having adjacent first and second portions, the first portion arranged to be inserted into a corresponding recess in a smoking article and applying an annular element around the second portion of the elongate cylinder.

The mouthpiece as described above and elsewhere herein can be a filter unit.

BRIEF DESCRIPTION OF THE DRAWINGS

Embodiments of the invention will now be described, by way of example only, with reference to the accompanying drawings, in which.

DETAILED DESCRIPTION

As used herein, the term "smoking article" includes smokable products such as cigarettes, cigars and cigarillos whether based on tobacco, tobacco derivatives, expanded tobacco, reconstituted tobacco or tobacco substitutes and also heat-not-burn (HnB) products, and other nicotine delivery products such as aerosol generation devices including e-cigarettes. The smoking article may be provided with a filter for the gaseous flow drawn by the smoker.

Smoking articles such as cigarettes and their formats are often named according to the cigarette length: "regular" (typically in the range 68-75 mm, e.g. from about 68 mm to about 72 mm), "short" or "mini" (68 mm or less), "king-size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the cigarette circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm).

Accordingly, a cigarette in a king-size, super-slim format will, for example, have a length of about 83 mm and a circumference of about 17 mm. Cigarettes in the regular, king-size format are preferred by many customers, namely with a circumference of from 23 to 25 mm and an overall length of from 75 to 91 mm.

Each format may be produced with filters of different lengths, smaller filters being generally used in formats of smaller lengths and circumferences. Typically the filter length will be from about 15 mm, associated with short, regular formats, to 30 mm, associated with ultra-long super-slim formats. The tipping paper will have a greater length than the filter, for example from 3 to 10 mm longer, such that the tipping paper covers the filter and overlaps the tobacco rod to connect the filter to the tobacco rod.

Smoking articles described herein can be made in any of the above formats.

Figure 1A:
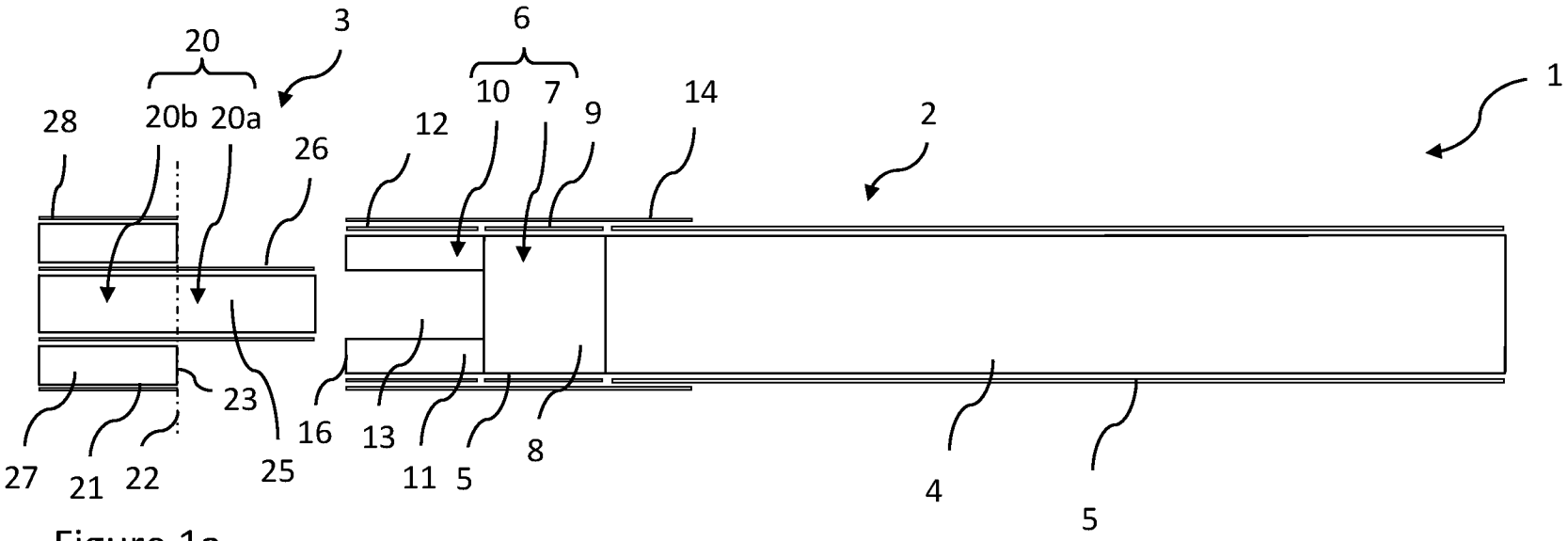
FIG. 1*a* is a side-on cross sectional view of a smoking article including a smoking article rod portion and a mouthpiece, in the present example a filter unit, separate from the smoking article rod portion.
Figure 1B:
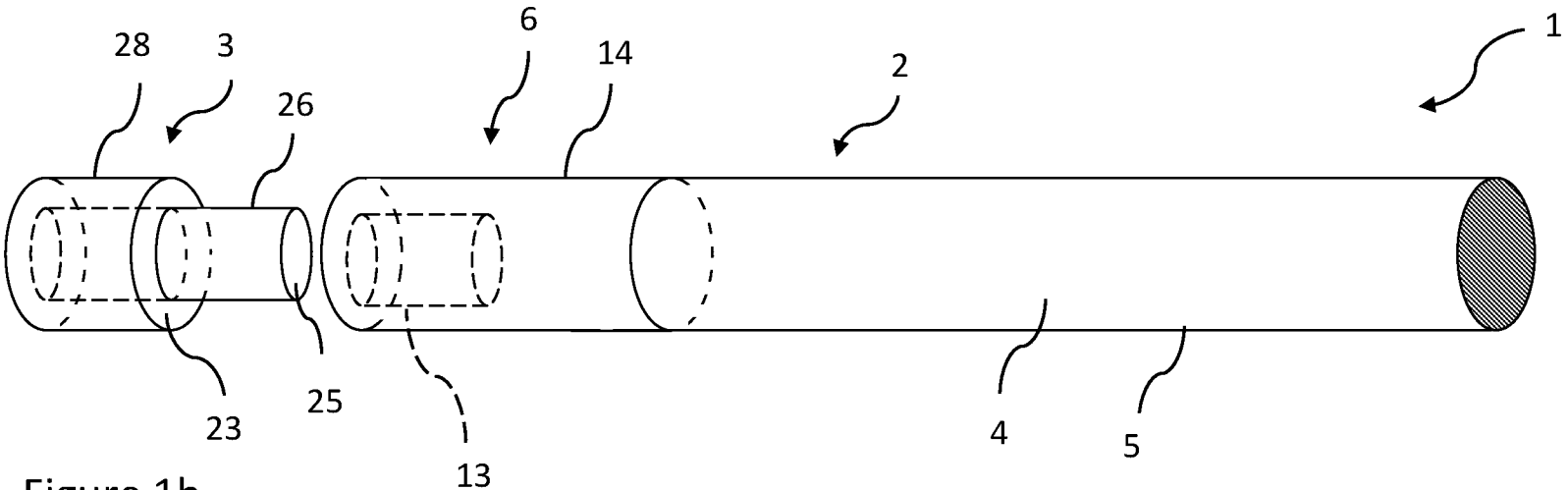
FIG. 1*b* is a perspective view of the smoking article shown in FIG. 1*a;*

FIG. 1*a* is a side-on cross sectional view of a smoking article 1 including a smoking article rod portion 2, also referred to as an aerosol generating portion, and a mouthpiece, in the present example a filter unit 3 separate from the smoking article rod portion 2 and attachable to the smoking article rod portion 2 by a user. FIG. 1*b* is a perspective view of the smoking article 1 shown in FIG. 1*a*. In the present example, the smoking article rod portion 2 is in the regular, king size format, namely having a length in the range 75-91 mm and a circumference in the range 23 to 25 mm. In particular, the length of the smoking article rod portion 2 is 83 mm and it has a circumference of 24.6 mm in the present example. The smoking article 1 is a cigarette and the smoking article rod portion 2 includes a tobacco rod 4 wrapped in a wrapping material 5, in this case cigarette paper. The smoking article rod portion 2 includes a filter 6 at its mouth end comprising a first section 7 located at the tobacco rod end of the filter 6. The first filter section 7 is, in the present example, formed from cellulose acetate tow 8 wrapped in a first plug wrap 9. The filter 6 also includes a second section located downstream of the first section 7 and comprising a tubular element 11 wrapped in a second plug wrap 12. The tubular element 11 is, in the present example, open at the mouth end of the smoking article rod portion 2 and defines a recess or cavity 13 at that end. A mouth end surface 16 of the tubular element 11 is exposed at the mouth end of the smoking article rod portion 2. The tobacco rod 4 and first and second filter sections 7, 10 are connected by a tipping material 14 overlaying the first and second filter sections 7, 10 and partially overlaying the wrapping material 5. In other embodiments, the first and second filter sections 7, 10, and any other sections forming the filter 6, can be connected together using a further plug wrap (not shown), prior to connection of the filter 6 to the tobacco rod 4 using the tipping material 14.

The filter unit 3 includes a cylindrical element 20 and an annular element 21. The cylindrical element 20 has adjacent first and second portions 20*a*, 20*b*, each extending partially along the length of the cylindrical element 20. In the present example, the first portion 20*a* extends from an insertion end of the cylindrical element 20 to an intermediate position 22 along the length of the cylindrical element 20. In the present example, the cylindrical element 20 is 13 mm in length and the intermediate position 22 is 6 mm along the length of the cylindrical element 20 from the insertion end. The first portion 20*a* of the cylindrical element 20 is arranged to be inserted, by a user, into the recess 13 at the mouth end of the smoking article rod portion 2.

The annular element 21 is arranged around the second portion 20*b* of the cylindrical element 20. The annular element 21 has a larger external diameter than the internal diameter of the recess 13. In the present example, the second portion 20*b* of the cylindrical element 20 extends from a mouth end of the cylindrical element 20 and ends at the intermediate position 22 along the length of the cylindrical element 20. A surface 23 of the annular element 21 is exposed on the end of the annular element 21 arranged to face the smoking article rod portion 2 in use, and abuts the mouth end surface 16 of the tubular element 11 when the filter unit 3 is attached to the smoking article rod portion 2, as described below.

The first portion 20*a* of the cylindrical element 20 is arranged to be inserted into a recess in a smoking article, in the present case into the recess 13 formed by the tube section 11. The internal diameter and/or length of the recess 13 and the external diameter and/or length of the first portion 20*a* of the cylindrical element 20 are arranged to substantially correspond such that the first portion 20*a* of the cylindrical element 20 can be received within and substantially fill the recess 13. For instance, the internal diameter and/or length of the recess 13 can be substantially the same as the external diameter and/or length of the first portion 20*a* of the cylindrical element 20. In practice, the correspondence between the dimensions of the recess 13 and those of the first portion 20*a* of the cylindrical element 20 will depend on the materials used to form these components and the desired closeness of the fit between them. It is likely to be preferable that the recess dimensions are slightly larger than the dimensions of the first portion 20*a*, to facilitate insertion of the cylindrical element 20 into the recess 13.

In the example of FIGS. 1*a* and 1*b*, the recess 13 has an internal diameter of 5.10 mm and the cylindrical element 20 has an external diameter of 5f3 mm. In alternative examples, the internal diameter of the recess 13 and external diameter of the cylindrical element 20 can have other values, for instance diameters in the range from 3 mm to 10 mm. In the example of FIGS. 1*a* and 1*b*, the recess 13 has an internal length of 6 mm and the first portion 20*a* of the cylindrical element 20 has a length of 6 mm. In alternative examples, the internal length of the recess 13 and length of the first portion 20*a* of the cylindrical element 20 can have other values, for instance lengths in the range from 3 mm to 20 mm.

In the present example, the annular element 21 is attached to the cylindrical element 20 using an adhesive (not shown). The annular element 21 may be attached to the cylindrical element 20 by means other than an adhesive, for example by mechanical means such as a friction fit or other locking arrangement.

In use, the smoking article 1 is provided to users with the filter unit 3 and smoking article rod portion 2 as separate components. Prior to a user first using the smoking article rod portion 2, the filter unit 3 can be attached to the smoking article rod portion 2 by inserting the first portion 20*a* of the cylindrical element 20 into the recess 13. The first portion 20*a* of the cylindrical element 20 is inserted into the opening of the recess 13 and pushed into the recess 13 until the surface 23 of the annular element 21 abuts the mouth end surface 16 of the tubular element 11, preventing further insertion. The user can select whether or not to attach the filter unit 3 to the smoking article rod portion 2 prior to smoking the smoking article 1, and can in this way control the length of filter of the smoking article 1 and therefore the level of filtration of the aerosol generated by the smoking article 1.

Figure 2A:
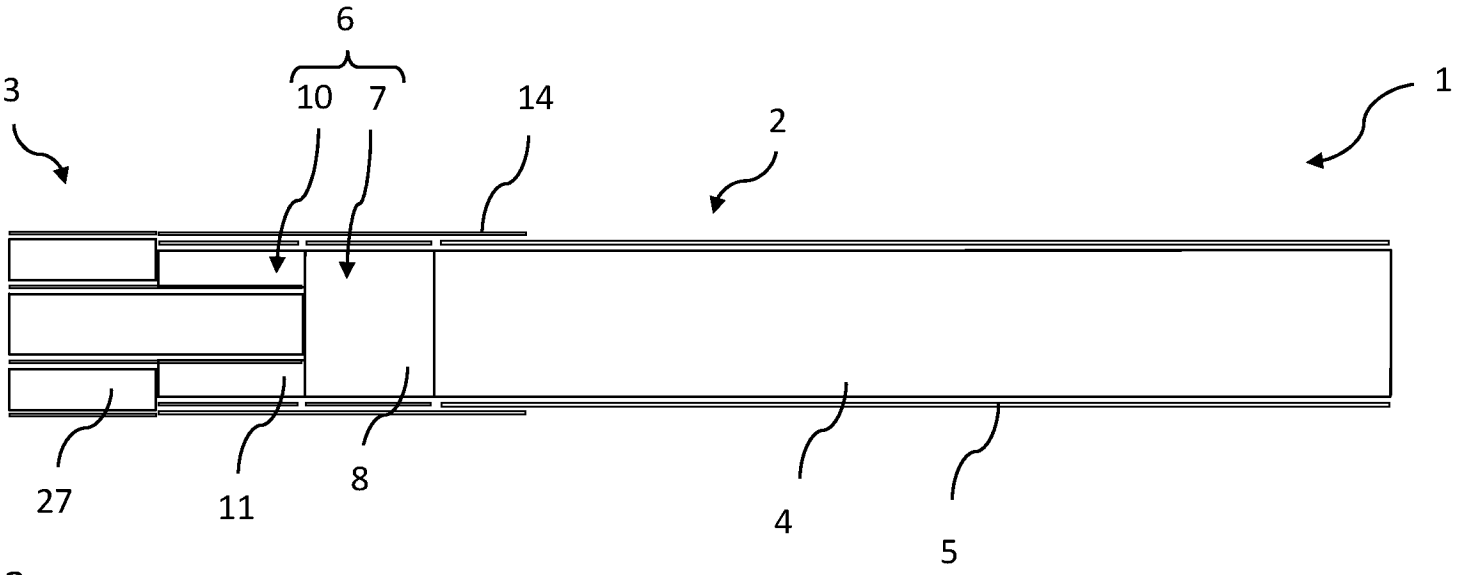
FIG. 2*a* is a side-on cross sectional view of the smoking article of FIG. 1*a* with the filter unit attached to the smoking article rod portion.
Figure 2B:
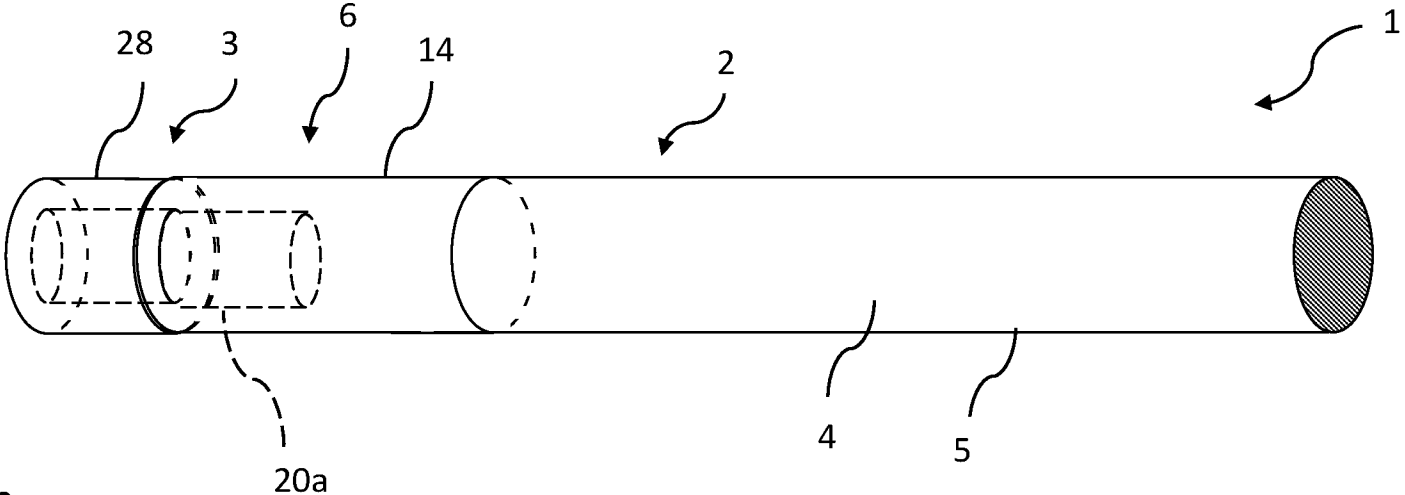
FIG. 2*b* is a perspective view of the smoking article shown in FIG. 2*a;*

FIG. 2*a* is a side-on cross sectional view of the smoking article 1 of FIGS. 1*a* and 1*b* with the filter unit 3 attached to the smoking article rod portion 2. FIG. 2*b* is a perspective view of the same smoking article 1 with the filter unit 3 attached to the smoking article rod portion 2.

In the present example, the cylindrical element 20 comprises fibrous filtration material and is circumferentially wrapped in a wrapper 26, in the present case plug wrap material, leaving its longitudinal ends unwrapped. In alternative embodiments, the cylindrical element 20 may be formed in other ways. The cylindrical element 20 may alternatively be formed from other fibrous materials and can be arranged to have a different construction. The cylindrical element 20 may, for instance, be formed from stiff paper, plastic, card or other materials as an open or closed ended hollow tube. The cylindrical element 20 also need not be wrapped in a wrapper, but could, for instance, be formed without a wrapper such as a non-wrapped acetate (NWA) plug formed from cellulose acetate fibres. The fibrous filtration material 25 may comprise cellulose acetate fibres and/or other materials used to form fibres, such as polyvinyl alcohol (PVOH), polylactic acid (PLA), polycaprolactone (PCL), poly(1-4 butanediol succinate) (PBS), poly(butylene adipate-co-terephthalate)(PBAT), starch based materials, paper, cotton, aliphatic polyester materials and polysaccharide polymers.

In the present example, the annular element 21 comprises fibrous filtration material 27, formed into a tube and circumferentially wrapped in a wrapper 28, in the present case plug wrap material, leaving its longitudinal ends unwrapped. In alternative embodiments the annular element 21 may be formed in other ways. For instance, the annular element 21 may alternatively be formed from other fibrous materials. The annular element 21 also need not be wrapped in a wrapper, but could, for instance, be formed without a wrapper such as a non-wrapped acetate (NWA) tube formed from cellulose acetate fibres. The fibrous filtration material 27 may comprise cellulose acetate fibres and/or other materials used to form fibres, such as polyvinyl alcohol (PVOH), polylactic acid (PLA), polycaprolactone (PCL), poly(1-4 butanediol succinate) (PBS), poly(butylene adipate-co-terephthalate)(PBAT), starch based materials, paper, cotton, aliphatic polyester materials and polysaccharide polymers. The annular element 21 may alternatively be formed from a sheet material, such as tipping paper, wrapped around the cylindrical element 20 to form a single or multiple layers of the sheet material around the cylindrical element 20. The annular element 21 may alternatively be formed from plastic or another moulded material.

The cylindrical element 20 and/or annular element 21 may contain a filter plasticiser. Filter plasticisers operate by softening the fibrous filter material from which a filter element is constructed such that the individual fibres can bond to each other to form a more rigid structure. A filter plasticiser such as glycerin triacetate, also referred to as triacetin, can, for instance, be used in the cylindrical element 20 and/or annular element 21 when these elements are formed from a fibrous filtration material such as cellulose acetate. A higher level of plasticiser than is usually used in a filter element can be used to provide additional firmness to either component. For instance, greater than 7%, greater than 10%, greater than 12% or greater than 15% plasticiser can be used in either component, by weight of the fibrous filtration material used.

In the present example, the longitudinal extent of the first portion 20*a* of the cylindrical element 20 is substantially equal to the longitudinal extent of the recess 13. The longitudinal extent of the first portion 20*a* of the cylindrical element 20 may, in alternative examples, be shorter or longer than the longitudinal extent of the recess 13.

The cylindrical element 20 and/or annular element 21 may comprise an aerosol modifying additive.

FIGS. 3*a* to 3*d* are side-on cross sectional views of respective mouthpieces, in the present example filter units 30, 40, 5*o*, 60, which can be used as alternative mouthpieces to the filter unit 3 described with reference to FIGS. 1*a*, 1*b*, 2*a*, and 2*b*. The filter units 30, 40, 50, 60 of FIGS. 3*a* to 3*d* are generally similar in construction to the filter unit 3 of FIG. 1*a*, and the same reference numerals are used to denote equivalent features.

Figure 3A:
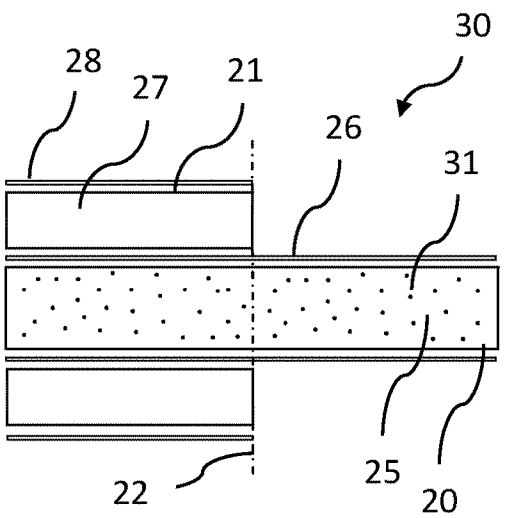
FIGS. 3(*a*) to 3(*d*) are side-on cross sectional views of respective mouthpieces, in these examples filter units, containing various smoke modifying additives for use with the smoking article illustrated in FIGS. 1*a*, 1*b*, 2*a* and 2*b;*

In the filter unit 30 of FIG. 3*a*, the fibrous filtration material 25 of the cylindrical element comprises particles of an aerosol modifying additive 31 disposed therein. The aerosol modifying additive 31 is, in the present example, activated carbon. However, other additives can be used, such as adsorbents other than carbon, or flavour imparting additives. For instance, the additive may be a botanical additive. The botanical additive, where local regulations permit, may comprise at least one plant based material selected from liquorice, hydrangea, Japanese white bark magnolia leaf, chamomile, fenugreek, clove, Japanese mint, aniseed, cinnamon, herb, wintergreen, spearmint, peppermint, lavender, cardamom, celery, cascarilla, geranium, vanilla, cassia, caraway, jasmine, ylang-ylang, sage, fennel, ginger, anise and coriander.

In the present embodiment, the aerosol modifying additive 31 is distributed throughout the fibrous filtration material 25 of the cylindrical element 20. The aerosol modifying additive 31 may alternatively or additionally be distributed throughout the fibrous filtration material 27 of the annular element 21.

Figure 3B:
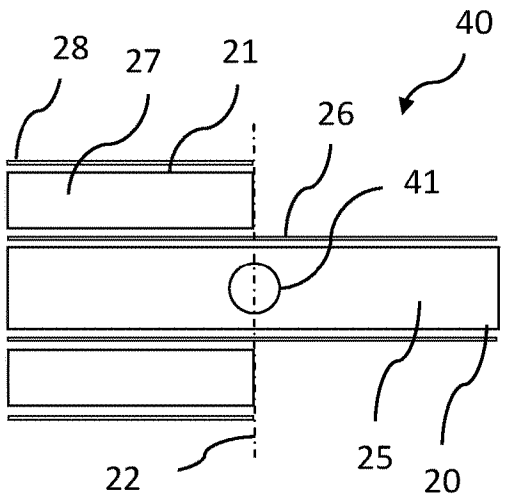

In the filter unit 40 of FIG. 3*b*, the fibrous filtration material 25 of the cylindrical element 20 comprises a frangible capsule 41 inserted therein containing a liquid payload comprising a flavourant, such as menthol. The frangible capsule 41 is positioned at the intermediate position 22 between the first and second portions 20*a*, 20*b* of the cylindrical element, and therefore lies beneath the end of the annular element 21 at that location. The user can squeeze the end of the annular element 21 to cause a pressure to be exerted on the capsule such that it breaks to release the flavourant contained therein to thus modify aerosol drawn through the filter unit 40.

Figure 3C:
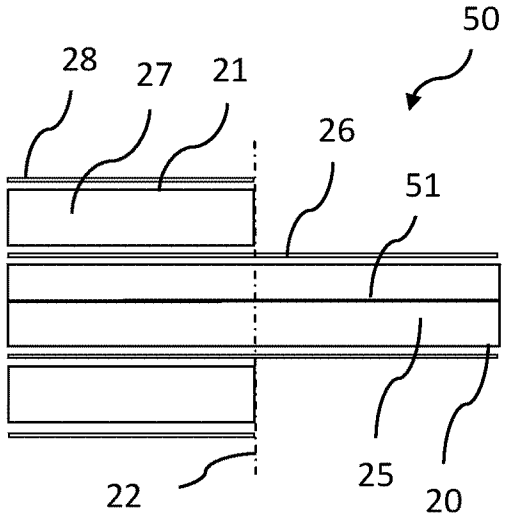

In the filter unit 50 of FIG. 3*c*, the fibrous filtration material 25 of the cylindrical element 20 comprises an elongate aerosol modifying element 51 inserted therein. In the present example, the elongate aerosol modifying element 51 comprises a thread loaded with a flavourant such as menthol. The flavourant loaded onto the thread 51 is released as aerosol is drawn through the filter unit 50.

Figure 3D:
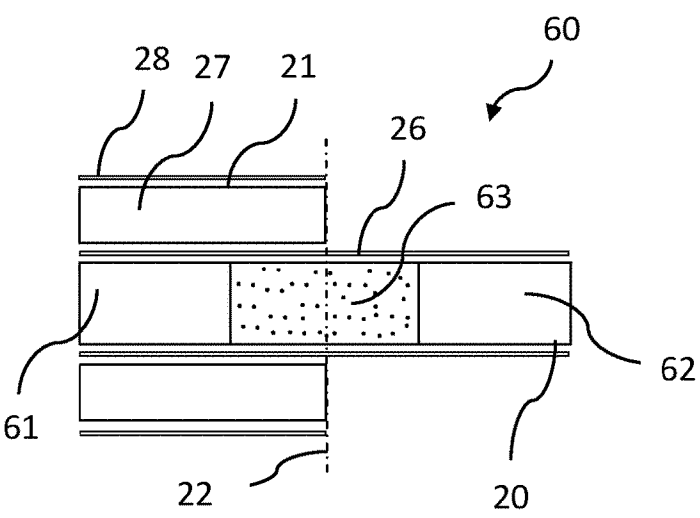

In the filter unit 60 of FIG. 3*d*, the cylindrical element 20 comprises a first plug 61 and a second plug 62, longitudinally aligned, separated and wrapped in the plug wrap 26 such that a cavity is formed between the first and second plugs 61, 62. The cavity contains an aerosol modifying additive 63 disposed therein, such as those described with reference to FIG. 3*a*.

In any of the mouthpieces or filter units described herein, an additional mouth-end filter section can be provided. In filter units containing additives such as activated carbon or botanical additives, the additional mouth-end filter section can prevent particles of such additives from reaching the user's mouth.

In addition or as an alternative to the feature of the filter units described herein, the wrapper wrapping the cylindrical element 20 and/or annular element 21 of the filter units described herein may comprise an additive such as menthol or chili flavour, to provide additional flavour, aroma and/or other sensate characteristics to the filter units.

Figure 4:
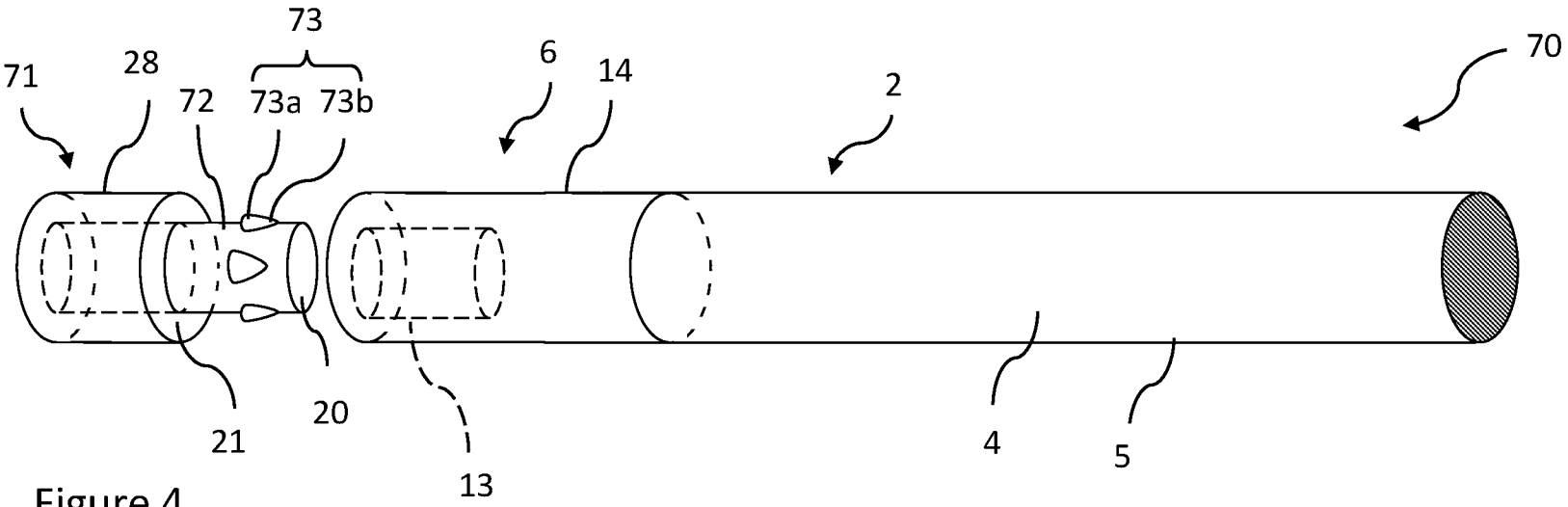
FIG. 4 is a perspective view of a smoking article including a smoking article rod portion and a mouthpiece, in the present example a filter unit, separate from the smoking article rod portion, and in which the filter unit comprises at least one raised area for holding the filter unit in engagement with the smoking article rod portion.

FIG. 4 is a perspective view of a smoking article 70 including a smoking article rod portion 2 and a mouthpiece, in the present example a filter unit 71, separate from the smoking article rod portion 2, and in which the filter unit 71 comprises at least one raised area 73 for holding the filter unit 71 in engagement with the smoking article rod portion 2. The smoking article 70 of FIG. 4 is generally similar in construction to the smoking article 1 of FIG. 1*a*, and the same reference numerals are used to denote equivalent features. The filter unit 71 comprises a cylindrical element 20 and an annular element 21 corresponding to those previously described. However, the outer surface of the first portion 20*a* of the cylindrical element 20 has at least one raised area 73 arranged to engage with an inner surface of the recess 13. In the present example four such raised areas 73 are disposed circumferentially around the first portion 20*a* of the cylindrical element 20. Each raised portion 73 protrudes approximately 1 mm at its highest point or region from the outer surface, although can be arranged to protrude more or less than this.

In the present example, the raised portions 73 are generally triangular shaped in both plan view and longitudinal cross sectional view, although other shapes can be used. The raised areas 73 are provided approximately half-way along the length of the first portion 20*a* of the cylindrical element, which in the present case is in a region about 3 mm from the annular element 21. However, the raised areas 73 can alternatively be provided in other locations around the first portion 20*a* of the cylindrical element 20.

The raised areas 73 are arranged to provide a resistance to the movement of the first portion 20*a* of the cylindrical element 20 within the recess 13. The raised areas 73 can also have the effect of centring the first portion 20*a* in the recess and providing a buffer between the cylindrical element and the recess to absorb any inaccuracies in the dimensions of either component caused by tolerances in the manufacture of either component. The raised areas 73 are arranged to provide a lower resistance to movement of the first portion 20*a* of the cylindrical element 20 into the recess 13 than out of the recess 13. This is achieved, in the present example, by the raised area 73 having a first section 73*a* with a relatively sharp incline as it rises away from the outer surface of the cylindrical element 20 to the highest point or region of the raised area 73, and a second section 73*b* with a relatively shallow incline as it rises away from the outer surface of the cylindrical element 20 to the highest point or region of the raised area 73. The second section 73*b* is arranged to face in the direction of movement of the cylindrical element 20 into the recess 13. The second section 73*b* is arranged to be forward of the first section 73*a* as the cylindrical element 20 is inserted into the recess 13. In particular, the second section 73*b* is closer to the end of the first portion 20*a* opposite to the annular element 21 than the first section 70*a*. The raised area 73 therefore provides a relatively low level of frictional engagement with the inner surface of the recess 13 on insertion of the first portion 20*a* into the recess 13. The first section 73*a* is arranged to face in the direction of movement of the cylindrical element 20 out of the recess 13. In particular, the first section 73*a* is closer to the end of the first portion 20*a* adjacent the annular element 21. The raised area 73 therefore provides a relatively high level of frictional engagement with the inner surface of the recess 13 on retraction of the first portion 20*a* out of the recess 13.

In the present example, the raised areas 73 also have a wider circumferential extent in the first section 73*a* as compared to the second section 73*b*, again providing greater frictional engagement with the inner surface of the recess 13 on extraction of the cylindrical element 20 as compared to insertion of the cylindrical element 20. In the present example, the circumferential extent of the raised areas 73 in the first section 73*a* is approximately 3 mm and in the second section 73*b* is approximately 0.5 mm, although other dimensions can be used.

In the present example, the at least one raised area 73 is formed by embossing the wrapper 72 which forms the outer surface of the cylindrical element 20. However, alternative arrangements are possible. For instance, the raised area 73 can be formed using an add-on material such as varnish, lacquer, adhesive or equivalent, or by a plastic, paper or other material protrusion which is adhered to the outer surface of the cylindrical element 20. In addition, any shape of raised portion 73 can be used which provides greater frictional engagement with the inner surface of the recess 13 on extraction of the cylindrical element 20 as compared to insertion of the cylindrical element 20.

Figure 5:
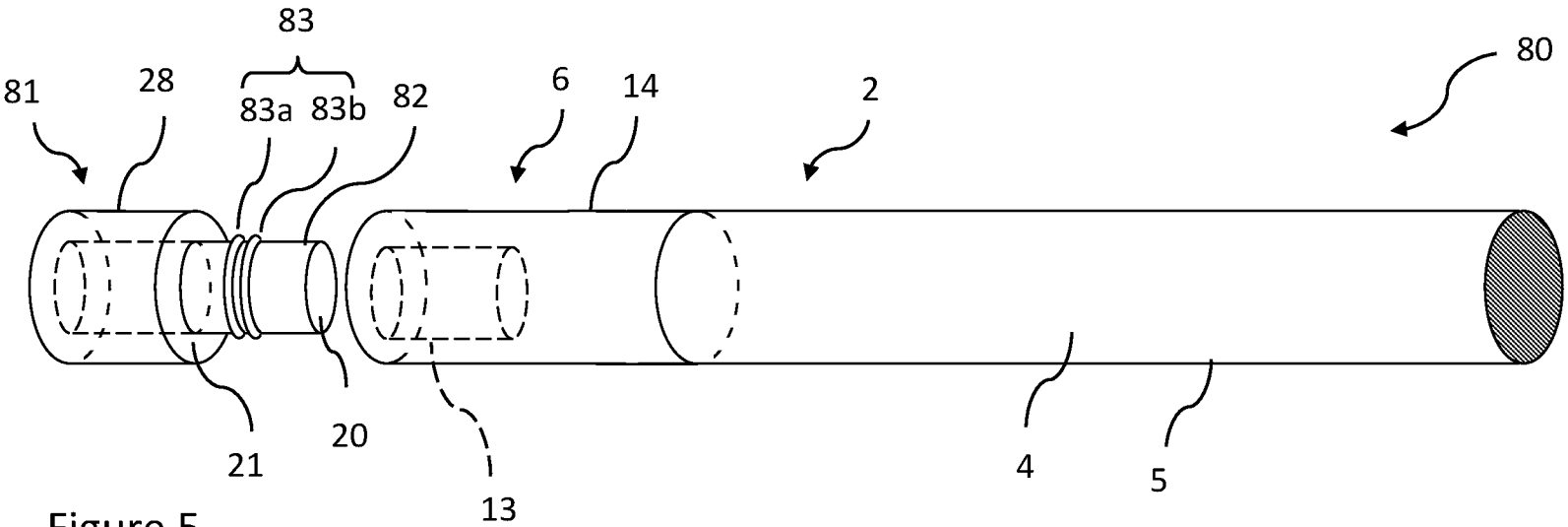
FIG. 5 is a perspective view of a smoking article including a smoking article rod portion and a mouthpiece, in the present example a filter unit separate from the smoking article rod portion, and in which the filter unit comprises at least one circumferentially extending raised area.

FIG. 5 is a perspective view of a smoking article 80 including a smoking article rod portion 2 and a mouthpiece, in the present example a filter unit 81, separate from the smoking article rod portion 2. The filter unit 81 comprises at least one circumferentially extending raised area 83. The smoking article 80 of FIG. 5 is generally similar in construction to the smoking article 1 of FIG. 1*a*, and the same reference numerals are used to denote equivalent features. The filter unit 81 comprises a cylindrical element 20 and an annular element 21 corresponding to those previously described. However, the outer surface of the first portion 20*a* of the cylindrical element has at least one circumferentially extending raised area 83 arranged to engage with an inner surface of the recess 13. In the present example, first and second circumferentially extending raised areas 83*a*, 83*b* are provided, longitudinally spaced apart. However, in alternative embodiments, a single circumferentially extending raised area 83 can be provided, or more than two can be provided.

The first and second circumferentially extending raised areas 83*a*, 83*b* each extend continuously around the outer surface of the first portion 20*a* of the cylindrical element 20. In particular, the circumferentially extending raised areas 83*a*, 83*b* extend around substantially the whole of the circumference of the cylindrical element 20, in the present example forming bands or rings around the cylindrical element 20. However, other arrangements are possible, such as circumferentially extending raised areas which extend around some, but not the whole of the outer surface of the cylindrical element 20, or areas having other patterns such as a spiral configuration.

The first and second circumferentially extending raised areas 83*a*, 83*b* each prevent or restrict air flow between the inner surface of the recess 13 and the outer surface of the cylindrical element 20. This is achieved by the circumferentially extending raised areas 83*a*, 83*b* forming a seal between the outer surface of the cylindrical element and the inner surface of the recess 13, by pressing against the inner surface of the recess 13. Preventing or restricting air flow between the inner surface of the recess 13 and the outer surface of the cylindrical element 20 can help to prevent or restrict external air from entering the smoking article 80 between the filter 6 of the smoking article rod portion 2 and the filter unit 83. In addition, Preventing or restricting air flow between the inner surface of the recess 13 and the outer surface of the cylindrical element 20 can help to prevent or restrict aerosol formed by the smoking article rod portion 2 bypassing the cylindrical element 20 and/or annular element 21 by passing between the two.

The circumferentially extending raised areas 83*a*, 83*b* can be formed by embossing the wrapper 82 forming the outer surface of the cylindrical element 20. In the present example, the circumferentially extending raised areas 83*a*, 83*b* are 1 mm in height above the surface of the cylindrical element 20 and have a width of 1 mm. However, other dimensions can be used, such as between 0.5 mm and 10 mm in width and between 0.5 mm and 5 mm in height. Also, in the present example the first and second circumferentially extending raised areas 83*a*, 83*b* are separated by a 2 mm spacing between them, although other spacing can be used, such as between 1 mm and 20 mm depending on the size and configuration of the cylindrical element 20. The circumferentially extending raised areas 83 are provided approximately half-way along the length of the first portion 20*a* of the cylindrical element, which in the present case is in a region about 3 mm from the annular element 21. However, the circumferentially extending raised portions 83 can alternatively be provided in other locations around the first portion 20*a* of the cylindrical element 20.

Figure 6:
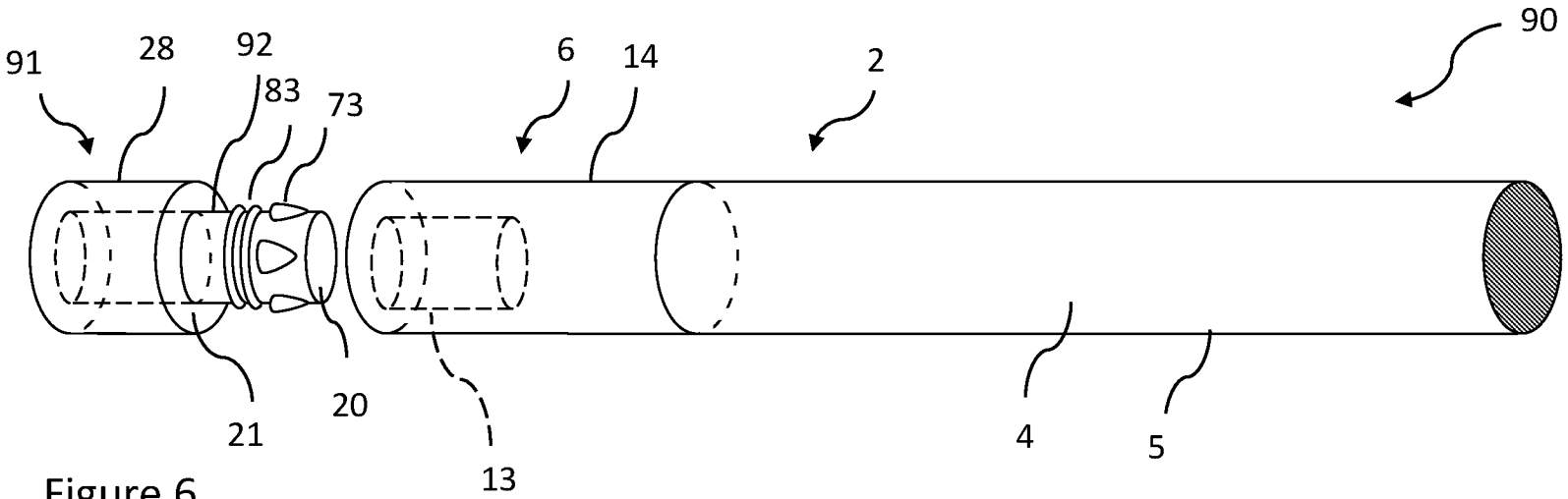
FIG. 6 is a perspective view of a smoking article including a smoking article rod portion and a mouthpiece, in the present example a filter unit separate from the smoking article rod portion, and in which the filter unit comprises both the at least one raised area illustrated in FIG. 4 and the at least one circumferentially extending raised area illustrated in FIG. 5.

FIG. 6 is a perspective view of a smoking article 90 including a smoking article rod portion 2 and a mouthpiece, in the present example a filter unit 91, separate from the smoking article rod portion 2, and in which the filter unit 91 comprises both the at least one raised area 73 as described with reference to FIG. 4, and the at least one circumferentially extending raised area 83 as described with reference to FIG. 5. The smoking article go of FIG. 6 is generally similar in construction to the smoking article 1 of FIG. 1*a*, and the same reference numerals are used to denote equivalent features. The at least one raised area 73 is provided on the outer surface of the first portion 20*a* of the cylindrical element 20 further from the annular element 21 than the at least one circumferentially extending raised area 83. In particular, in the present example, four raised areas 73 are provided spaced around the circumference of the cylindrical element 20 and spaced approximately 4 mm from the annular element 21. First and second circumferentially extending raised areas 83 are provided, spaced approximately 2 mm from the annular element 21. The raised areas 73 and circumferentially extending raised areas 83 can be formed by embossing the wrapper 92 forming the outer surface of the cylindrical element 20.

Figure 7:
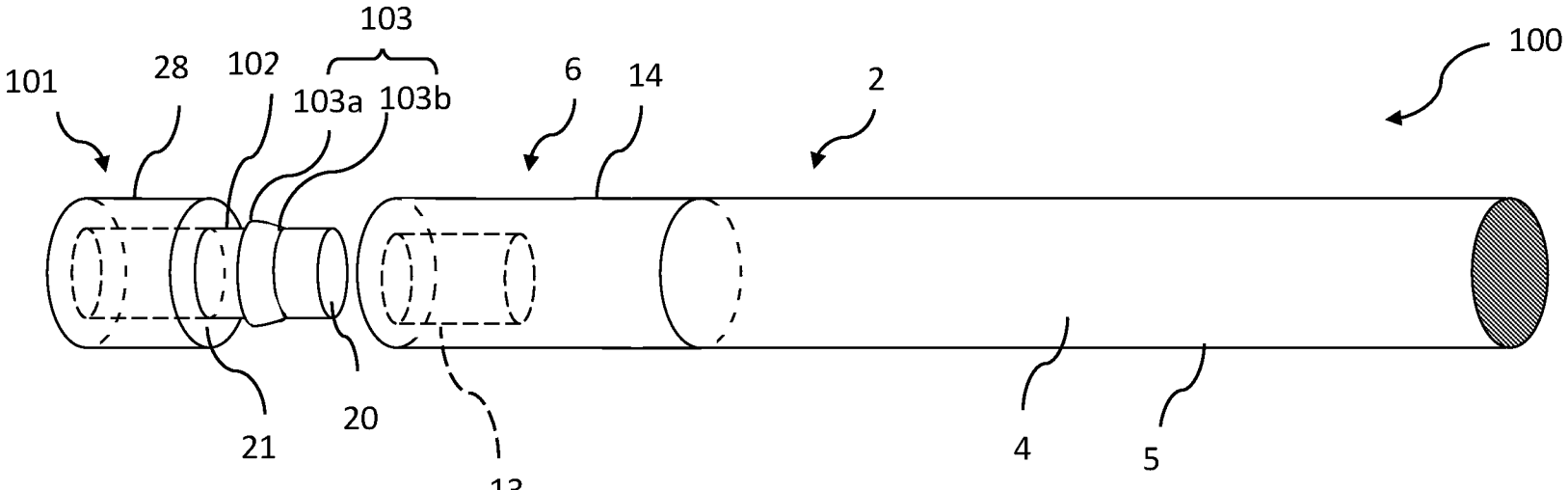
FIG. 7 is a perspective view of a smoking article including a smoking article rod portion and a mouthpiece, in the present example a filter unit separate from the smoking article rod portion, and in which the filter unit comprises at least one circumferentially extending raised area for holding the filter unit in engagement with the smoking article rod portion.

FIG. 7 is a perspective view of a smoking article 100 including a smoking article rod portion 2 and a mouthpiece, in the present example a filter unit 101 separate from the smoking article rod portion 2, and in which the filter unit 101 comprises at least one circumferentially extending raised area 103 for holding the filter unit 101 in engagement with the smoking article rod portion 2. The smoking article 100 of FIG. 7 is generally similar in construction to the smoking article 1 of FIG. 1*a*, and the same reference numerals are used to denote equivalent features. The at least one circumferentially extending raised area 103 has the combined functions of the at least one raised area 73 described with reference to FIG. 4 and the at least one circumferentially extending raised area described with reference to FIG. 5. In particular, the circumferentially extending raised area 103 is formed so as to have a forward section 103*b* with a relatively shallow incline as it rises away from the outer surface of the cylindrical element 20 to the highest point or region of the raised area 103, and a rearward section 103*a* with a relatively steep incline as it rises away from the outer surface of the cylindrical element 20 to the highest point or region of the raised area 103. The circumferentially extending raised area 103 therefore provides a relatively low level of frictional engagement with the inner surface of the recess 13 on insertion of the cylindrical element 20 into the recess 13 and a relatively high level of frictional engagement with the inner surface of the recess 13 on retraction of the cylindrical element 20 out of the recess 13. In addition, the circumferentially extending raised area 103 also acts to prevent or restrict air flow between the inner surface of the recess 13 and the outer surface of the cylindrical element 20.

Figure 8:
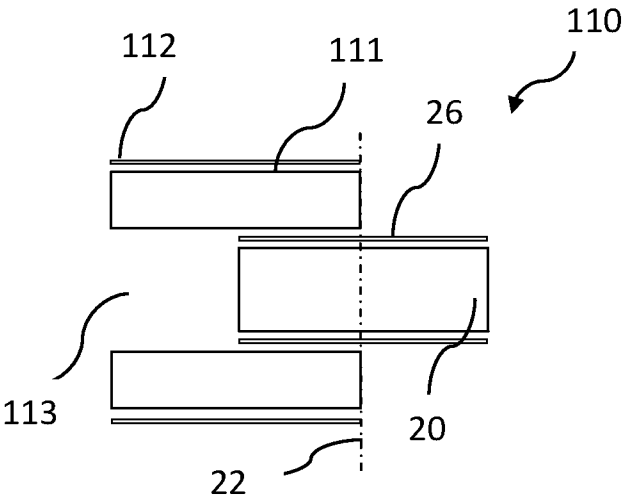
FIG. 8 is a side-on cross sectional view of a mouthpiece, in the present example a filter unit having an offset cylindrical element, for use with the smoking article illustrated in FIGS. 1*a*, 1*b*, 2*a* and 2*b;*

FIG. 8 is a side-on cross sectional view of a mouthpiece, in the present example a filter unit 110, having an offset cylindrical element 20, for use with the smoking articles described herein. The filter unit no includes a cylindrical element 20 and an annular element 11. The cylindrical element 20 is substantially the same as the cylindrical elements 20 described previously. However, in the present example, the annular element 111 is arranged around the second portion 20*b* of the cylindrical element 20 and also extends beyond the mouth end of the cylindrical element 20. The annular element 111, in the present example, has the same longitudinal length as the cylindrical element 20. In particular, in the present example, both the cylindrical element 20 and the annular element 21 have a length of 13 mm. The intermediate position 22 is 6 mm along the length of the cylindrical element 20 from the insertion end, as previously described, and therefore the annular element 21 extends 6 mm beyond the mouth end of the cylindrical element 20. The annular element 111 is wrapper in a wrapper 112, such as tipping paper. The filter unit 110 of FIG. 8 therefore has a recess 113 at its mouth end, which can receive the first portion 20*a* of a cylindrical element 20 of a filter unit as described herein.

The filter unit 110 of FIG. 8 can be adapted to include any of the features of the filter units of FIGS. 3*a* to 3*d*. A user can therefore select a first filter unit 110 as illustrated in FIG. 8, but including an aerosol modifying additive, and attach it to a smoking article rod portion 2 as described herein. The user can then select a further second filter unit, selected from any of the filter units described herein, and attach that filter unit to the first filter unit no. This enables a user to achieve the properties, such as filtration and aerosol modifying properties, of multiple filter units which can be connected to the same smoking article rod portion 2.

Figure 9:
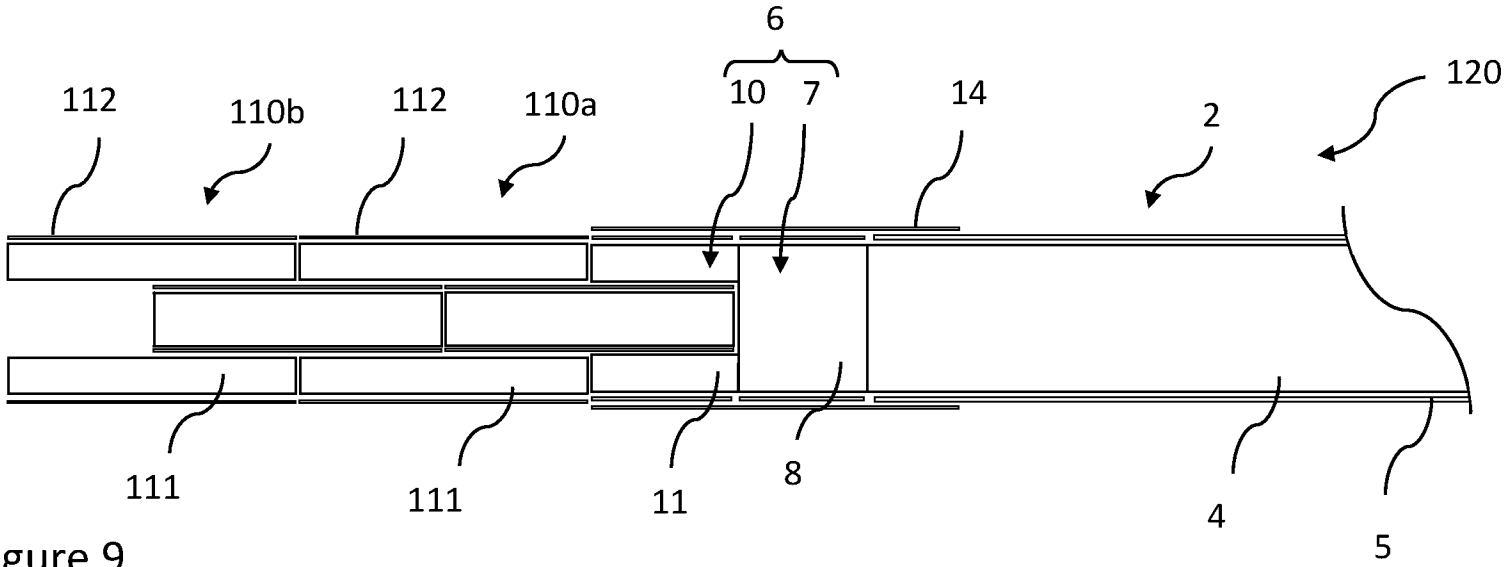
FIG. 9 is a side-on cross sectional view of a smoking article including a smoking article rod portion and two of the filter units of FIG. 8 connected to the smoking article rod portion.

FIG. 9 is a side-on cross sectional view of a smoking article 120 including a smoking article rod portion 2 and first 110*a* and second nob of the filter units no of FIG. 8, connected to the smoking article rod portion 2. The smoking article 120 of FIG. 9 is generally similar in construction to the smoking article 1 of FIG. 1*a*, and the same reference numerals are used to denote equivalent features.

Figure 10:
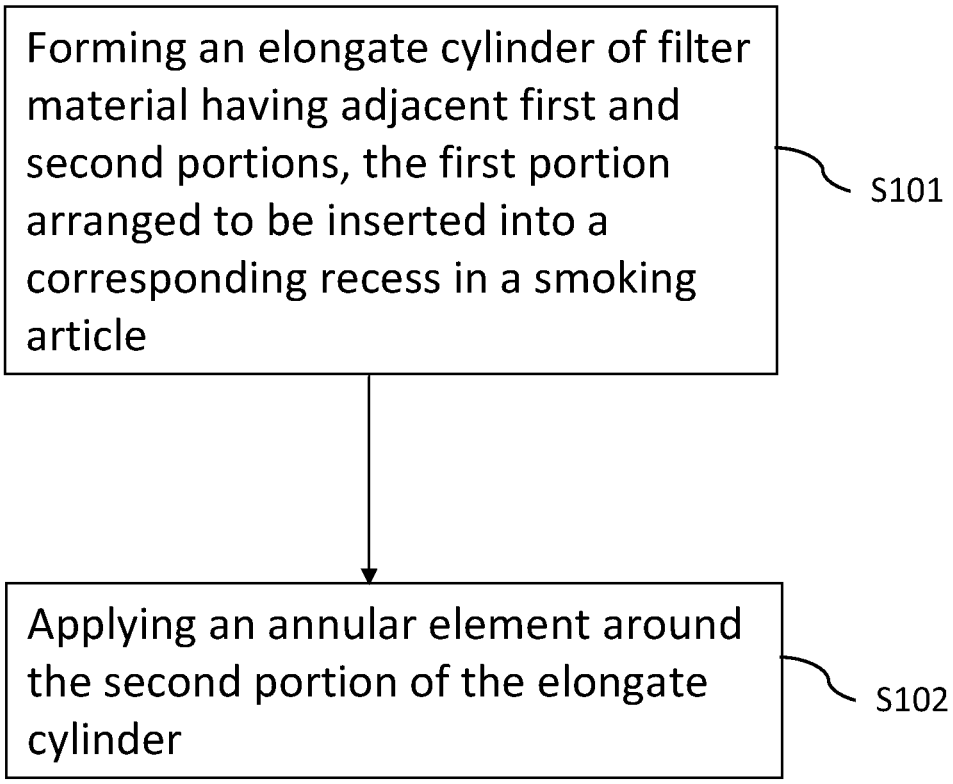
FIG. 10 is a flow diagram illustrating a method for forming a mouthpiece, in the present example a filter unit, as described herein.

FIG. 10 is a flow diagram illustrating a method for forming a mouthpiece, in the present example a filter unit, as described herein. In a first step (S101) an elongate cylinder of filter material is formed having adjacent first and second portions, the first portion arranged to be inserted into a corresponding recess in a smoking article. The cylinder can, for instance, be formed using a filter rod maker in which filter tow is fed from a supply thereof into a garniture section of the maker in which it is compressed into a rod shape and wrapped in a wrapper such as a plug wrap. The plug wrap can be provided with embossed raised areas forming the raised areas 73 and the circumferentially extending raised areas 83 as described herein. The cylinder can be cut to its final length on the filter rod maker or into lengths which are multiples of its desired final length, which can be cut to size when combined with the annular element 21. In a second step (S102) an annular element 21 is applied around the second portion 20*b* of the elongate cylinder formed in step S101. For instance, the annular element 21 may be formed by wrapping a sheet material around the cylinder, or by sliding a tubular filter section over the cylinder. In each case, the annular element 21 can be adhered to the outer surface of the cylindrical element using an adhesive.

Figure 11:
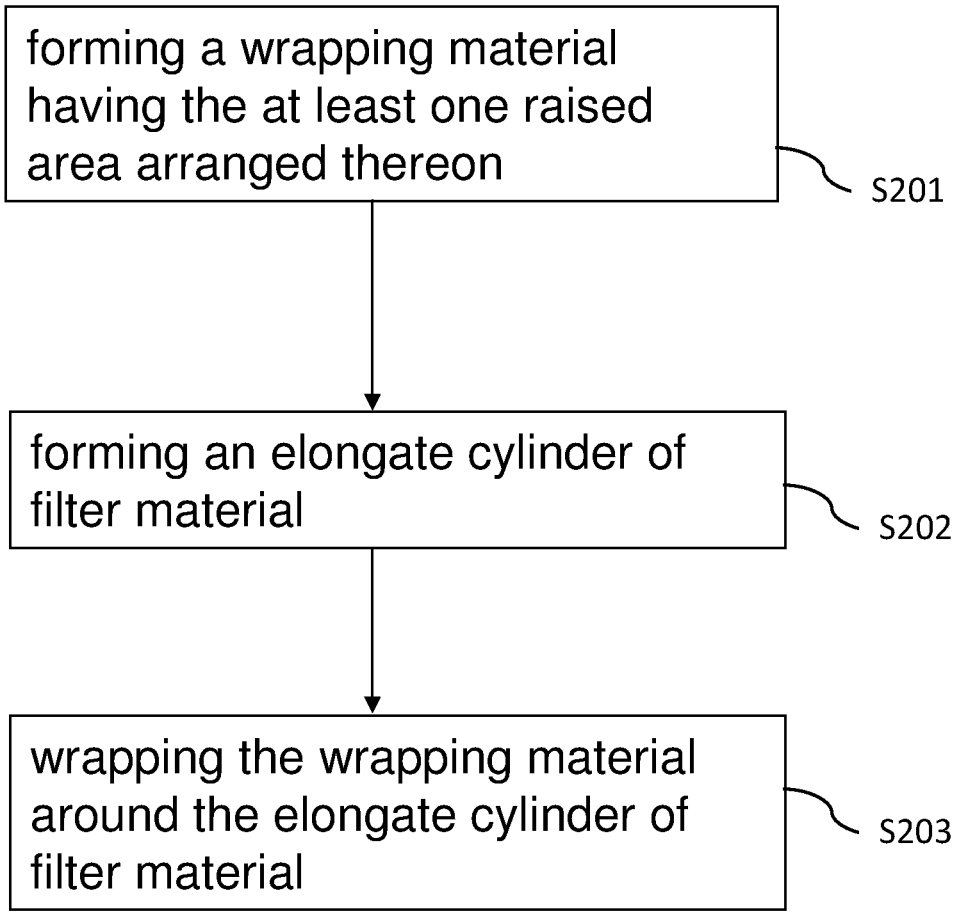
FIG. 11 is a flow diagram illustrating a method for forming the cylindrical element of the filter unit described with reference to FIG. 4.

FIG. 11 is a flow diagram illustrating a method for forming the cylindrical element of the filter unit 71 as described herein with reference to FIG. 4. In a first step (S201), a wrapping material having the at least one raised area arranged thereon is formed. For instance, a sheet wrapping material such as a plug wrap can be embossed or otherwise provided with the at least one raised area arranged thereon. In a second step (S202), an elongate cylinder of filter material is formed, for instance using a filter rod maker. The cylinder can, for instance, be formed using a filter rod maker in which filter tow is fed from a supply thereof into a garniture section of the maker in which it is compressed into a rod shape. In a third step (S203), the wrapping material is wrapped around the elongate cylinder of filter material. The cylinder of filter material can be cut to its final length on the filter rod maker or into lengths which are multiples of its desired final length, which can be cut to size at a later stage.

Figure 12:
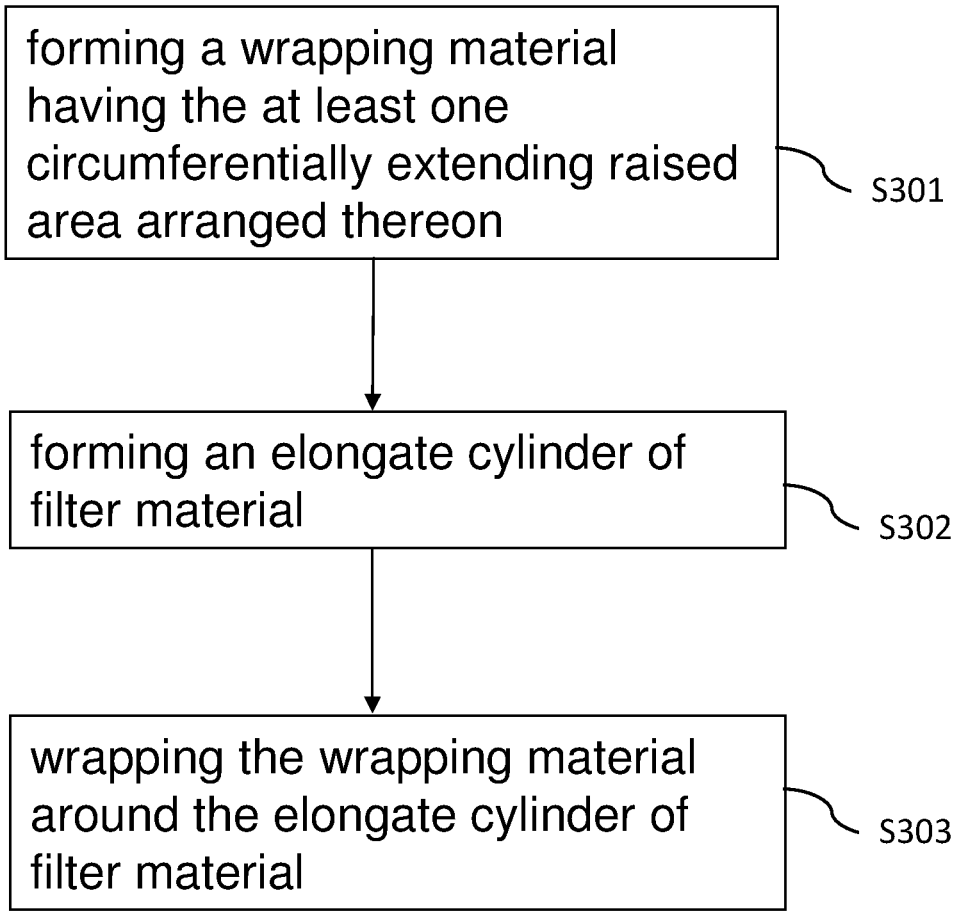
FIG. 12 is a flow diagram illustrating a method for forming the cylindrical element of the filter unit described with reference to FIG. 5.

FIG. 12 is a flow diagram illustrating a method for forming the cylindrical element of the filter unit 81 as described herein with reference to FIG. 5. In a first step (S301), a wrapping material having the at least one circumferentially extending raised area arranged thereon is formed. For instance, a sheet wrapping material such as a plug wrap can be embossed or otherwise provided with the at least one circumferentially extending raised area arranged thereon. In a second step (S302), an elongate cylinder of filter material is formed, for instance using a filter rod maker. The cylinder can, for instance, be formed using a filter rod maker in which filter tow is fed from a supply thereof into a garniture section of the maker in which it is compressed into a rod shape. In a third step (S303), the wrapping material is wrapped around the elongate cylinder of filter material. The cylinder of filter material can be cut to its final length on the filter rod maker or into lengths which are multiples of its desired final length, which can be cut to size at a later stage.

The smoking articles described herein provide users with the ability to modify the characteristics of the smoking article prior to or during use of the smoking article. Any of the filter units 3, 30, 40, 50, 60, 71, 81, 91, 101, 110 described herein can be attached to any of the smoking article rod portions 2. For instance, a user can be supplied with one or more smoking article rod portions 2 and a selection of the filter units 3, 30, 40, 50, 60, 71, 81, 91, 101, 110 which can be selectively attached to the rod portions 2 by the user as desired.

Although certain arrangements for the filter units 3, 30, 40, 50, 60, 71, 81, 91, 101, 110 and smoking article rod portions 2 have been described herein, alternative designs are possible. For instance, in some embodiments, the annular element 21 of the respective filter unit 3, 30, 40, 50, 60, 71, 81, 91, 101, 110 can be omitted, and a filter unit provided comprising just the cylindrical element 20. In this case, the cylindrical element 20 may comprise both first and second portions 20*a*, 20*b*, or just the first portion 20*a* arranged to be received within the recess 13. Mouthpieces other than filter units as described herein can be used, for instance a tubular mouthpiece with an axial flowpath therethrough, formed from a material such as plastic (polyvinyl chloride or other similar polymer material), paper or card. Mouthpieces which do not perform a filtration function, or provide a limited filtration function, can be provided for use in non-combustible smoking articles such as heat-not-burn (HnB) products and other nicotine delivery products such as aerosol generation devices including e-cigarettes. Such mouthpieces could, for instance, comprise the same structure and materials as the filter units described herein. In addition, although the smoking article rod portions 2 have been described as having first and second filter sections 7, 10, they can alternatively include just the first filter section 7, or additional filter sections in addition to the first and second filter sections 7, 10. For instance, the smoking article rod portions 2 described herein may comprise an additional third filter section at the tobacco rod end of the filter 6, this third section comprising an adsorbent such as activated carbon dispersed therein. Furthermore, the smoking article rod portions 2 need not include the second filter section 10 and can have instead a recess 13 at the mouth end of the smoking article rod portion 2 formed by a stiff plug wrap or tipping material. In this case, the corresponding filter units would be adapted to fit this alternative recess arrangement.

Embossing has been described herein for forming the raised areas 73, 83, 103 on their respective wrappers. Such wrappers can be embossed between a pair of suitably-shaped cooperating rollers to form the raised areas 73, 83, 103. Multiple wrappers may be embossed simultaneously and in parallel between the rollers.

In order to address various issues and advance the art, the entirety of this disclosure shows by way of illustration various examples in which the claimed invention(s) may be practiced and provide for superior smoking articles and filter units. The advantages and features of the disclosure are of a representative sample of examples only, and are not exhaustive and/or exclusive. They are presented only to assist in understanding and teach the claimed features. It is to be understood that advantages, examples, examples, functions, features, structures, and/or other aspects of the disclosure are not to be considered limitations on the disclosure as defined by the claims or limitations on equivalents to the claims, and that other examples may be utilised and modifications may be made without departing from the scope and/or spirit of the disclosure. Various examples may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A mouthpiece attachable to a smoking article rod portion having a recess defined by a tubular element, the mouthpiece comprising an elongate cylindrical element, having adjacent first and second portions each extending partially along the length of the cylindrical element, the second portion forming a mouth-end of the mouthpiece and the first portion being arranged to be inserted into the recess by a user; and an annular element formed from a molded material, the annular element having a larger external diameter than the first portion of the cylindrical element, and wherein the cylindrical element comprises a cavity comprising particles of an aerosol modifying additive; and the mouthpiece having a larger external diameter at the second portion than the internal diameter of the recess, and wherein the first portion of the cylindrical element comprises an outer surface having at least one circumferentially extending raised area, and wherein the circumferentially extending raised area extends around substantially the whole circumference of the cylindrical element, and wherein the annular element extends beyond the mouth-end of the cylindrical element, forming a recess at the mouth-end of the mouthpiece.

2. A mouthpiece according to claim 1, wherein the cylindrical element and/or annular element comprises a smoke modifying additive.

3. A mouthpiece according to claim 2, wherein:

the smoke modifying additive is distributed throughout the cylindrical element and/or annular element;

wherein the smoke modifying additive is contained within at least one frangible capsule;

wherein the smoke modifying additive comprises a botanical additive;

wherein the smoke modifying additive comprises an adsorbent; and/or wherein the additive is loaded on a thread extending through the cylindrical element and/or annular element.

4. A mouthpiece according to claim 1, wherein the annular element is attached to the cylindrical element using an adhesive.

5. A mouthpiece according to claim 1, wherein the first portion of the cylindrical element comprises an outer surface having at least one raised area.

6. A mouthpiece according to claim 5, wherein the at least one raised area is formed by embossing an outer surface of the cylindrical element.

7. A mouthpiece according to claim 1, wherein the cylindrical element and the annular element have the same length, and/or wherein the body of the cylindrical element comprises fibrous filtration material.

8. A smoking article comprising:

a smoking article rod portion comprising a tubular element defining a recess; and a mouthpiece according to claim 1, wherein the annular element has a larger external diameter than the internal diameter of the recess.

9. A smoking article according to claim 8, wherein the internal diameter and/or length of the recess and the external diameter and/or length of the first portion of the cylindrical element are arranged to substantially correspond such that the first portion of the cylindrical element can be received within and substantially fill the recess.

10. A smoking article according to claim 8, wherein the first portion of the cylindrical element comprises an outer surface having at least one raised area and wherein the at least one raised area is arranged to engage with an inner surface of the recess and provides a resistance to movement of the first portion of the cylindrical element within the recess and is arranged to provide a lower resistance to movement of the cylindrical element into the recess than out of the recess.

11. A smoking article according to claim 10, wherein the at least one circumferentially extending raised area is configured to engage with an inner surface of the corresponding recess to prevent or restrict air flow between the inner surface of the corresponding recess and the outer surface of the cylindrical element.

12. A mouthpiece according to claim 1, wherein the cylindrical element and/or annular element comprises a smoke modifying additive.

* * * * *